US005806780A

United States Patent [19]

Schneider et al.

[11] Patent Number: 5,806,780

[45] Date of Patent: Sep. 15, 1998

[54] UNIVERSAL CABLE TAKE-OFF SYSTEM

[75] Inventors: Christopher J. Schneider, Solon; Scott D. Odom, Mc Donald; Charles C. Masimore, Girard, all of Ohio

[73] Assignee: General Motors Corporation, Detroit, Mich.

[21] Appl. No.: 837,510

[22] Filed: Apr. 14, 1997

[51] Int. Cl.[6] ..... B65H 49/00

[52] U.S. Cl. ..... 242/419; 242/128

[58] Field of Search ..... 242/128, 149, 242/419, 419.4, 419.5, 419.6, 419.7; 188/65.2, 65.5

[56] References Cited

U.S. PATENT DOCUMENTS

| | | | |
|---|---|---|---|
| 2,838,922 | 6/1958 | Gift | 242/128 |
| 2,864,565 | 12/1958 | Whearley | 242/128 |
| 3,203,642 | 8/1965 | Hirst | 242/128 |
| 3,863,861 | 2/1975 | Bellasio | 242/419 |
| 3,879,978 | 4/1975 | Harris, Jr. | 242/128 |
| 3,995,758 | 12/1976 | Kovaleski | 242/128 |
| 3,995,786 | 12/1976 | Deniega | 242/128 |
| 4,171,783 | 10/1979 | Waltemath | 242/128 |
| 4,186,897 | 2/1980 | Brown | 242/128 |
| 4,222,535 | 9/1980 | Hosbein | 242/128 |
| 4,322,047 | 3/1982 | Bonnabaud | 242/128 |
| 5,040,741 | 8/1991 | Brown | 242/128 |
| 5,181,666 | 1/1993 | Bitzer | 242/128 |
| 5,277,314 | 1/1994 | Cooper et al. | 242/148 |

FOREIGN PATENT DOCUMENTS

| | | | |
|---|---|---|---|
| 2 661 118 | 10/1991 | France | 242/419 |
| 39 14 754 C1 | 10/1990 | Germany | 242/419.5 |
| 1320154 A1 | 6/1987 | U.S.S.R. | 242/419.4 |
| 1391759 A1 | 4/1988 | U.S.S.R. | 242/419.5 |

*Primary Examiner*—John P. Darling
*Attorney, Agent, or Firm*—Cary W. Brooks

[57] ABSTRACT

A sub-system for controlling the flow of cable pulled from a cable pack by an automatic cable processing machine. The sub-system may include a barrel cap for containing and controlling the outward momentum of the cable over a cable pack such as a barrel and guiding the cable through a passage in the top of the cap. The passage is positioned in line with a center line of the barrel. A variable rate braking system may be positioned over the barrel and adjacent an outer wall of the barrel to control the circular movement of the cable as the cable is unwound from the barrel. A spacer may be positioned to prevent the cable from being pulled towards the center of the barrel or toward the barrel core and so that the cable engages the variable rate braking system. The system prevents cable from overlapping, entangling, knotting and snapping during the automatic processing of the cable for use in wire harnesses.

17 Claims, 4 Drawing Sheets

UNIVERSAL CABLE TAKE-OFF SYSTEM

TECHNICAL FIELD

This invention relates to a method and equipment for processing wire cable.

BACKGROUND OF THE INVENTION

Wire cable can be utilized to making wire harness assemblies. However, the wire must first be coated with an electrical insulation material, and thereafter post coating operations performed before it can be utilized in making wire harness assemblies. After the coating operation is complete, the cable is typically wound onto spools or into cable packs such as barrels. Barrels are a preferred method of shipping the cable because the barrel protects the outer windings of the cable from damage during shipment. Further, barrels with a core are more preferred because they also prevent the cable from shifting and becoming entangled during shipment. After the cable has been wound into a barrel, the barrels are placed into a truck and shipped a long distance to a processing facility to perform subsequent operations.

At the processing facility, the cable wire is then fed into an automatic cable processing machine. The automatic cable processing machine pulls the cable out of the barrel and into the machine at predetermined lengths. The machine then stops pulling the cable, cuts, terminates and crimps the ends of the cable for use in wire harness assemblies. Heretofore, the cable often became entangled, knotted or snapped during the repetitive pull-stop action of the automatic cable processing machines.

The present invention provides advantages over and alternatives to the prior art.

SUMMARY OF THE INVENTION

The present invention includes a sub-system for controlling the flow of cable pulled from a cable pack such as a barrel by an automatic cable processing machine. The sub-system may include a barrel cap for containing and controlling the outward momentum of the cable over the barrel and guiding the cable through a passage in the top of the cap. The passage is positioned in line with a center line of the barrel. A variable rate braking system may be positioned over the barrel and adjacent an outer wall of the barrel to control the circular movement of the cable as the cable is unwound from the barrel. A spacer may be positioned to prevent the cable from being pulled towards the center of the barrel or toward the barrel core and so that the cable engages the variable rate braking system. The system prevents cable from overlapping, entangling, knotting and snapping during the automatic processing of the cable for use in wire harnesses.

In a preferred embodiment, a conical shaped cap is provided to control the cables outward momentum. The rim of the conical shaped cap is lined with inwardly facing brushes having a free end nearest the center line of the cap to control the circular movement of the cable and to provide a variable rate braking action. A barrel disk is provided over the center of the barrel to keep the cable within the brushes while ensuring that the cable is pulled away from the center of the barrel, and particularly away from the core of the barrel. A continuous tensioning device is provided having two counter rotating belts. The belt surfaces move with the cable as the cable is pulled through by the automatic cable processing machine. The counter rotating belts minimize friction, reduce the potential for insulation damage and do not add memory characteristics to the cable. This results in straighter cable entering the automatic cable processing machine. The belt tension ratio allows the cable to move through the belts as the processing machine pulls the cable but also exhibits the appropriate braking action to stop the cables momentum when the pulling operation of the cable processing machine is stopped. An alignment device is provided for mounting the sub-system to the automatic cable processing machine and to eliminate any damage associated with misalignment.

These and other objects features and advantages of the present invention will become apparent from the following brief description of the drawings, detailed description, and appended claims and drawings.

DETAILED DESCRIPTION

Figure 2:
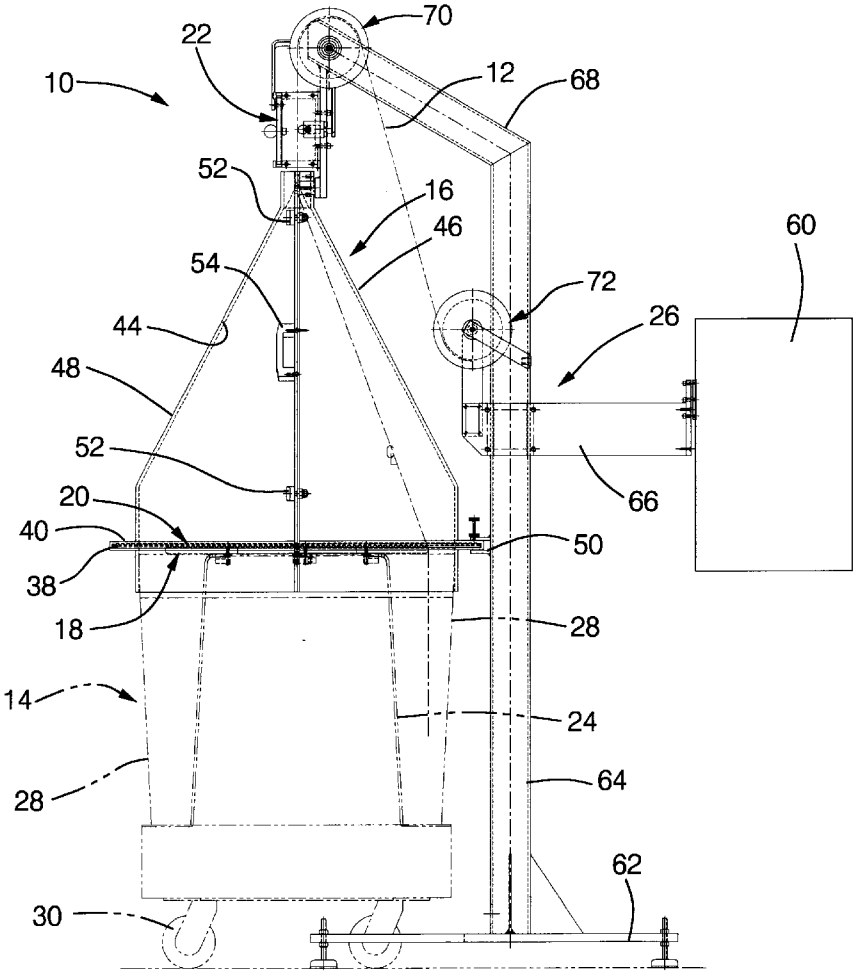
FIG. 2 is a side view of a sub-system according to the present invention.
Figure 1:
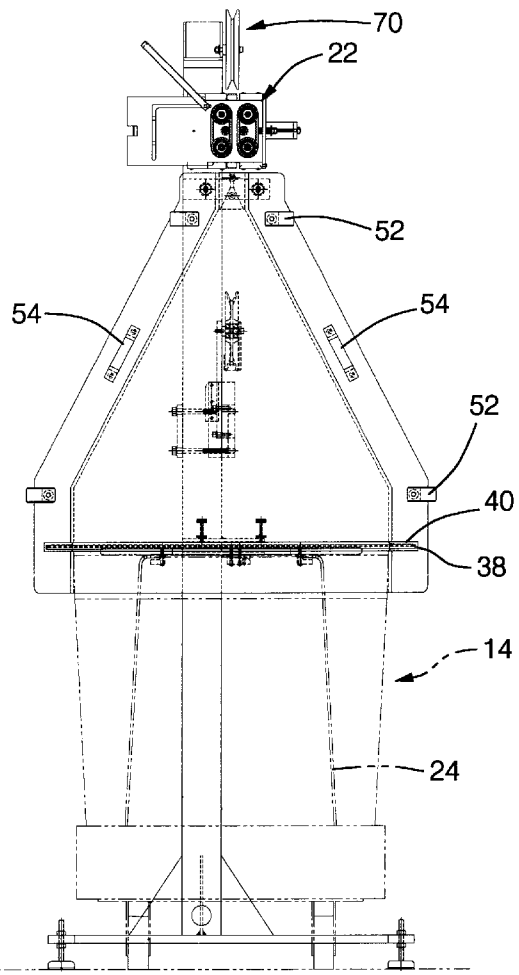
FIG. 1 is a front view a sub-system according to the present invention.

A preferred embodiment of the present invention is illustrated in FIGS. 1 and 2. The five main features of this embodiment are integrated into a sub-system 10 that controls the wire cable 12 as it is pulled from a cable pack such as a barrel 14. First, the sub-system 10 includes a cap 16 overlying a barrel 14 and is constructed and arranged to guide the cable 12 and control the cables 12 outward momentum above the barrel as the cable is rapidly pulled by the automatic cable processing machine. Second, the sub-system includes a variable rate braking system 18 to control the circular momentum of the cable 12. Third, a spacer 20 is provided to keep the cable within the variable rate braking system 18 and to insure that the cable is pulled away from the center of the barrel 14 and particularly away from the core 24 of the barrel. Fourth, the system includes a rotating tensioning system 22 to control the movement of the cable and to prevent potential damage to the cable insulation. Fifth, the sub-system includes an alignment system 26 for directing the cable and properly mounting the sub-system to the automatic cable processing machine. Details of each of the five main features of the preferred embodiment and the equipment it is intended to be useful with will now be described.

Figure 6:
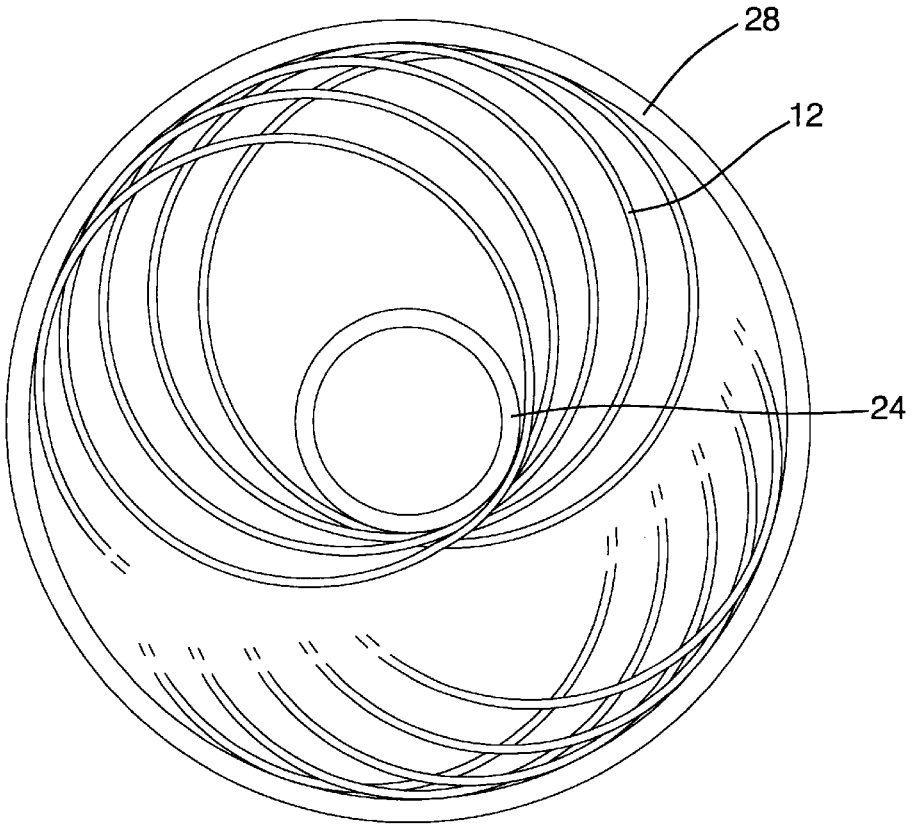
FIG. 6 illustrates a barrel with a central core and cable wound in the barrel that is useful with the present invention.
Figure 7:
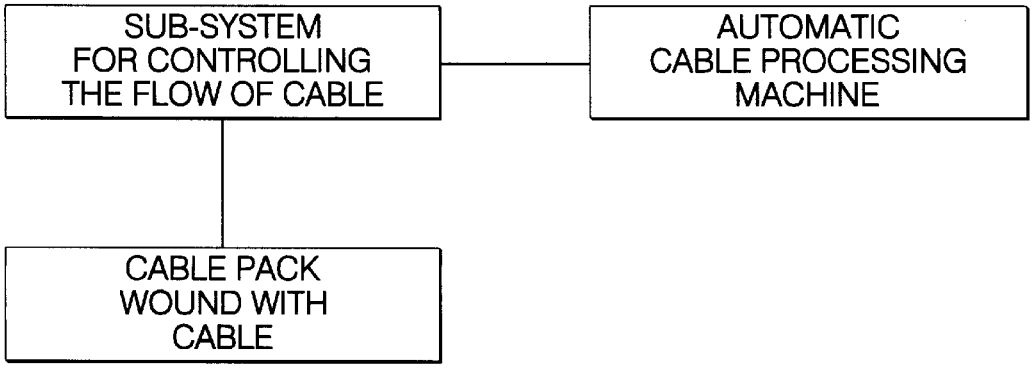
FIG. 7 is a schematic illustration of a sub-system according to the invention being used to control the flow of cable pulled for a barrel by an automatic cable processing machine.

The sub-system of the present invention is useful in controlling the flow of cable pulled by an automatic cable processing machine as schematically illustrated by FIG. 7. The sub-system is useful with a variety of different cable packs such as a bag, box, spool and the like having cable wound on or therein. Preferably, the cable pack is a barrel 14 having a generally cylindrical outer wall 28 and a tapered central core 24 around which the cable 12 has been wrapped (FIGS. 1, 2 and 6). The barrel 14 may include wheels 30 attached to a lower end or may be provided ion any device for easy movement of the barrel around the processing facility.

A variable rate braking system 18 is provided adjacent the outer wall 28 of the barrel. In a preferred embodiment illustrated in FIG. 3, the variable rate braking system includes two inwardly facing, curved arced or semi-circular shaped brushes 32 to control the circular momentum of the cable. The brushes 32 each have bristles 34 including a first end fixed 36 to an arc shaped or a semi-circular base 38 which can be received in a slot 40 formed in one of the cone shaped cap halves 46, 48. The brush bristles 34 each have a second end 42 which is free to move and extends inwardly towards the center of the barrel. The brushes 32 provide a variable rate braking action as the cable is pulled from the barrel. When the cable is pulled from the barrel, the cable tends to move towards the center of the barrel and towards the free end 42 of the brush bristles. The cable moves in a circular pattern as the cable is being unwounded from the barrel, and the free end 42 of the brush subjects the cable to very little resistance or breaking action. After the automatic cable processing machine has pulled a predetermined length of cable, the machine stops pulling the cable. Although the machine has stopped pulling the cable, the cable still has a circular and an outward momentum which forces the cable toward the fixed end 36 of the brush bristles which supplies a substantial amount of resistance or braking action to the cable and stops the cable almost immediately.

Thus, the brush 32 with a free end 42 of the bristle extending inwardly towards the barrel provides a variable rate braking action by supplying very little resistance to movement of the cable as the cable begins to be pulled out of the barrel, and the fixed end 36 of the bristle applies a substantial amount of resistance or braking action as the cable processing machine stops pulling cable from the barrel. Immediately stopping the cable from moving when the machine stops pulling prevents the cable from overlapping and becoming entangled in the barrel. If the cable becomes entangled in the barrel, the cable will be snapped the next time the machine begins to pull cable. Consequently, an operator must thread the cable into the machine again which results in a substantial amount of down time.

Figure 3:
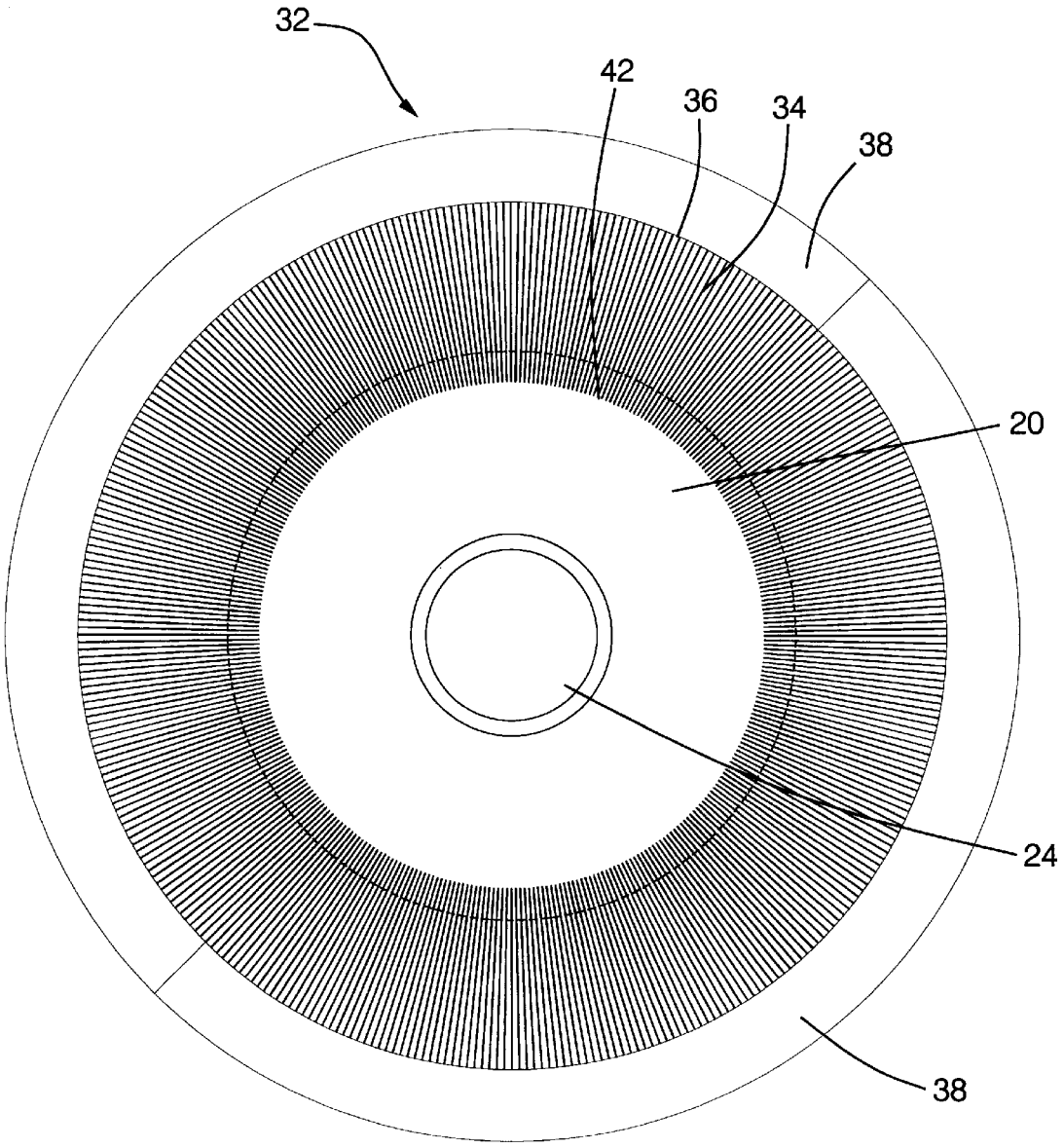
FIG. 3 is an enlarged view of a brush and spacer subassembly according to the present invention.

Referring to FIG. 3, the preferred embodiment also includes a spacer 20 which may be a disk placed over the barrel 14 and constructed and arranged to prevent the cable from moving towards the center of the barrel. The spacer 20 keeps the cable near the free end 42 of the brushes to insure that the cable is properly controlled by the variable rate braking system. Preferably the spacer 20 extends up to the free end 42 of the brush bristle and more preferably under the free end 42 to insure that the cable always engages the brush. The spacer may be a variety of shapes such as disk shaped and clipped to the core 24 of the barrel or may be ring shaped and place on top or over the upper portion of the tapered barrel core 24.

The cap 16 may have any of a variety of configurations sufficient to control the outward momentum of the cable and limit the cables tendency to arc outwardly above the barrel as the cable is rapidly pulled from the barrel. Suitable configurations of the cap may include vaulted or domed shapes, or more preferably a cone shape as illustrated in FIGS. 1 and 2. The cable tends to arc outwardly above the barrel due to the centrifugal force and outward momentum caused by the rapid pulling of the cable by the processing machine. If left unrestricted, the arcing cable may get caught on process equipment or the momentum may cause the cable to overlap other windings and become entangled when the machine stops pulling. However, the cap physically restrains the arcing and outward momentum or movement of the cable. Preferably the cone shaped cap is a two piece structure with a first half 46 secured to a flange 50 on the alignment system 26. The second half 48 of the cone shaped cap is removable from the first half 46. Quick release lock mechanisms 52 are provided to removably secure the two halves of the cone shaped cap. Handles 54 may be provided to assist in the easy removal of one of the cap halves. With one of the cap halves 48 removed, for the barrel 14 is rolled into and received by the other cap half 46. The second cap half 48 is then secured to the first cap half 46 to enclose an upper portion of the barrel 14. Naturally, a single piece cap can be lowered over the barrel.

Figure 4:
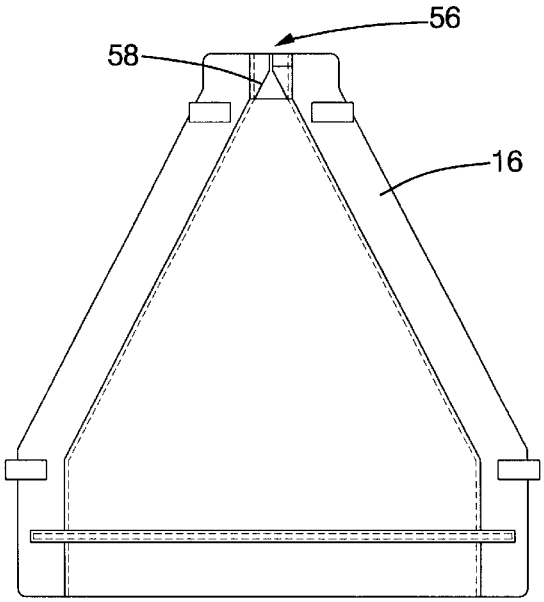
FIG. 4 is an enlarged view of a cap according to the present invention.

Referring to FIG. 4, preferably the cap 16 has a hole or passage 56 formed near the top of the cap and positioned substantially in line within a center line of the barrel 14. Preferably a funnel shaped guide member 58 is positioned to guide the cable through the hole formed in the cap so that the cable does not engage any sharp edges which would damage the insulative (insulation) coating on the cable.

Referring to FIG. 2, the sub-system also includes an alignment device 26 that is firmly secured to the automatic cable processing machine 60 so that the sub-system is held in place. The alignment device 26 may have a variety of configurations but preferably includes a base 62 and a vertically extending arm 64 secured to the base. An adjustable bracket 66 extends horizontally from the vertical arm 64 to secure the sub-system to the automatic cable processing machine 60. A second arm 68 is secured at an angle to the top of the vertical arm. A continuous tensioning device 22 is secured to the second arm and extends downwardly toward the top of the cone shaped cap. The cable is fed through the funnel 58 and passage 56 in the cap 16, through the continuous tensioning device 22, over a first roller or pulley 70 on the second arm 68, under a second roller or pulley 72 on the vertical arm 64 so that the cable can be fed in a horizontal direction into the automatic cable processing machine 60. The alignment device 26 preferably is constructed from adjustable arms 64, 68 and bracket 66 so that the device can be easily modified to accommodate a variety of automatic cable processing machines that are currently on the market or future designs.

Figure 5:
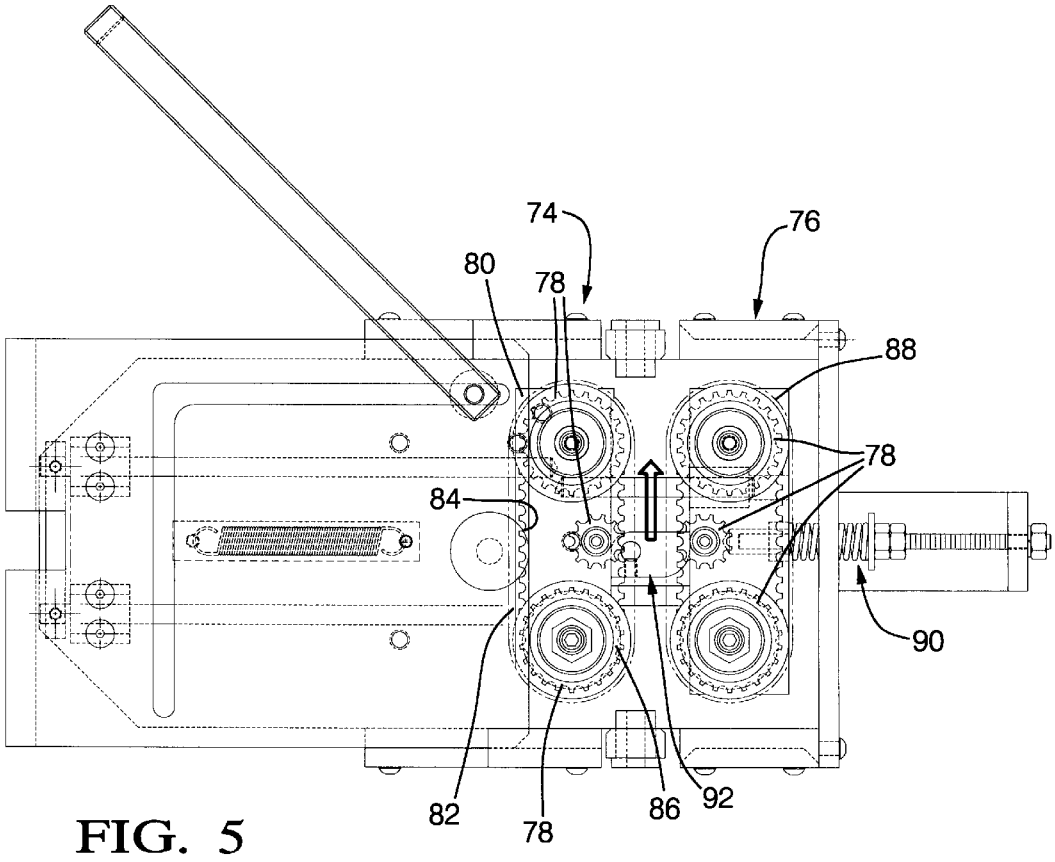
FIG. 5 is an enlarged view of a constant tensioning device according to the present invention.

Referring to FIG. 5, the continuous tensioning device 22 includes counter rotating brake members 74, 76 for applying a constant tension to the cable 12 as it is pulled into the automatic cable processing machine. Rotating brake members are preferred over stationary braking elements which may cause damage to the cable insulation or cause bending or kinking of the cable. Preferably the rotating brake members 74, 76 including a first braking element 74 having a plurality of bearing loaded rollers 78 secured to a stationary substrate 80. A belt 82 rides on the bearing loaded rollers 78. Preferably the belt 82 and rollers 78 have mating teeth 84, 86 respectively to prevent the belt from slipping over the rollers. A second rotating brake member 76 is similarly constructed but the bearing loaded rollers 78 are secured to a movable substrate 88 which is biased towards the first rotating brake member 74 by a spring 90. A lever arm 92 connected to a cam may be provided to allow the two rotating brake members 74, 76 to be easily held apart to facilitate stringing the cable through the constant tensioning device 22. The belts 82 rotate in opposite directions so that the cable 12 and belts 82 are moving in unison up through the tensioning device in the direction of the arrow shown in FIG. 5. This is important because the counter direction moving belts 82 provide an almost immediate stopping action without damaging the cable insulation or adding any memory characteristics to the cable so that a straighter cable is presented to the automatic cable processing machine.

Where the term cable is used herein it includes bare wire or wire coated with an insulation or wire with other improvements.

We claim:

1. A sub-system for controlling the flow of cable pulled from a barrel by an automatic cable processing machine comprising a conical shaped cap to be positioned over and receive a portion of the barrel, the conical shaped cap having first and second halves, a first half being secured in a fixed position, and the second half being removably secured to the first half, a passage defined in the top of the conical shaped cap for receiving cable threaded therethrough, a brush secured to an inside wall of the cap to control the circular movement of the cable, the brush having a free end extending radially inward toward a center line of the cap and having a fixed end radially distant from the free end, a disk positioned over a portion of the barrel to the prevent the cable from being pulled towards the center of the barrel and so that the cable moves in a circular path engaging the brush, and a pair of counter rotating tension belts positioned above the cap for applying a constant tension on the cable and to stop the cable when the automatic processing machine stops pulling cable.

2. A sub-system as set forth in claim 1 further comprising an alignment device to which the first half of the conical shaped cap is secured, the alignment device including a first bracket for securing to the automatic cable processing machine and an arm secured to the bracket, a first pulley over which a cable may be threaded and secured to the arm at a positioned above the to counter rotating belts, and a second pulley secured to the arm and positioned below the first pulley and under which the cable may be threaded and fed in a horizontal direction to the automatic cable processing machine.

3. A sub-system as set forth in claim 1 further comprising a funnel positioned in the cap and aligned to communicate with the passage to provide a smooth surface over which the cable may travel to prevent damage to an insulative coating on the cable.

4. A sub-system for controlling the flow of cable pulled by an automatic cable processing machine from a cable pack wound with cable constructed to reduce entanglement, knotting and snapping of the cable comprising:

a brush having a fixed end positioned at a location generally corresponding to an outer surface of the cable pack and the brush having a free end extending towards a center line of the cable pack, the brush providing a variable rate breaking action wherein the cable engages the free end of the brush to apply limited resistance to the circular movement of the cable as the cable begins to be pulled from the cable pack by the automatic cable processing machine, and wherein the cable engages the brush near the fixed end to applying a greater resistance than the limited resistance applied by the free end of the brush and stop the circular movement of the cable when the automatic cable processing machine stops pulling cable, and further comprising a constant tension device positioned above the cable pack generally in line with the center line of the cable pack for applying a constant tension to the cable and to stop the movement to the cable at the location of the tension device substantially immediately when the automatic cable processing machine stops pulling cable.

5. A sub-system as set forth the in claim 4 further comprising a cap having a passage formed in a top portion thereof for receiving the cable therethrough, the cap limiting the outward momentum of the cable being pulled by the automatic cable processing machine.

6. A sub-system as set forth in claim 4 wherein said cable pack comprises barrel.

7. A sub-system as set forth in claim 4 wherein the brush comprises a plurality of bristles.

8. A method of controlling the flow of cable pulled from a cable pack by an automatic cable processing machine to reduce entanglement, knotting, and snapping of the cable comprising;

providing a cable pack for carrying wound cable;

providing an automatic cable processing machine for performing post coating processing operations on the cable and capable of periodically pulling predetermined lengths of cable from the cable pack;

and providing a sub-system for controlling the flow of cable from the cable pack as the cable this periodically pulled by the automatic cable processing machine in a start-up fashion;

operating the automatic cable processing machine to perform the step of pulling a predetermined length of cable into the machine;

the sub-system directing the cable away from the center line of the cable pack and applying a limited resistance breaking action so that the circular movement of the cable is substantially unrestricted during the pulling step;

stopping the pulling step by the automatic cable processing machine, and the sub-system applying a greater resistance than the limited resistance applied by the free end of the brush to stop the circular of movement of the cable substantially immediately;

and further comprising the step of applying a constant tension to the cable at a location above the passage, the tension being sufficient to stop the movement of the cable at the location substantially immediately upon stopping the step of pulling the cable by the automatic cable processing machine;

and wherein the step of applying a constant tension to the cable is performed by tension device including at least a first and second set of rotating rollers that applying resistance to the movement of the cable through the tension device.

9. A method as set forth in claim 8 wherein the sub-system further controls the flow of cable by guiding the cable through a passage positioned above and generally in line with the center line of the cable pack and limiting the outward momentum of the cable over the cable pack as the cable is pulled from the cable pack to reduce entanglement, knotting or snapping upon repeated steps of starting and stopping the pulling of the cable by the automatic cable processing machine.

10. A method as set forth in claim 9 wherein the sub-system includes a conical shaped cap overlying the cable pack and having the passage formed in the top thereof, and the conical shaped cap performing the steps of guiding and limiting.

11. A method as set forth in claim 10 wherein the cap includes a conical shaped wall to restrict the outward momentum of the cable and guide the cable through a passage in the top of the cap.

12. A method as set forth in claim 9 wherein the first and second set of rotating rollers of the tensioning device rotate in counter directions, and the tensioning device further comprising a flexible belt for traveling on a respective set of rotating rollers.

13. A sub-system as set forth in claim 8 wherein said cable pack comprises a barrel.

14. A subsystem for controlling the flow of cable pulled from a cable pack by an automatic cable processing machine comprising a brush having a base and bristles, each bristle having one end secured to the base and a free end extending inward toward a center line of the cable pack, and further comprising a cap having a passage formed in the top portion of the cap for threading the cable through the passage and constructed and arranged to restrict the outward momentum of the cable above the cable pack as a cable this rapidly pulled from the cable pack, and further comprising a spacer for placement over a center portion of the cable pack to keep the cable pulled from the cable pack near the free ends of bristles.

15. A sub-system as set forth in claim 14 further comprising a constant tension device to constantly apply tension to the cable as it is pulled and positioned above the cable pack.

16. A sub-system as set forth in claim 14 wherein the barrel includes an outer wall and the base of the brush is adjacent the outer wall and distant from the center line of the barrel.

17. A sub-system for controlling the flow cable pulled by an automatic cable processing machine from a cable pack wound with cable and constructed to reduce entanglement, knotting and snapping of the cable comprising:

a brush having of fixed end positioned at a location generally corresponding to an outer surface of the cable pack and the brush having a free end extending towards a center line of the cable pack, the brush providing a variable rate breaking action wherein the cable engages the free end of the brush to apply limited resistance to the circular movement of the cable as the cable begins to be pulled from the cable pack by the automatic cable processing machine, and wherein the cable engages the brush near the fixed end to apply a greater resistance than the resistance applied by the free end of the brush and to stop the circular movement of the cable when the automatic cable processing machine stops pulling cable, and further comprising a cap having a conical shaped wall and a passage formed in the top portion of the cap for receiving the cable therethrough, the cap limiting the outward momentum of the cable being pulled by the automatic cable processing machine.

* * * * *